United States Patent [19]

Reilly

[11] 4,150,521

[45] Apr. 24, 1979

[54] PACKAGING APPARATUS

[76] Inventor: John Reilly, 278 Killaughey Rd., Donaghadee, County Down, Northern Ireland

[21] Appl. No.: 868,838

[22] Filed: Jan. 12, 1978

[51] Int. Cl.[2] ..... B65B 39/06; A22C 11/06

[52] U.S. Cl. ..... 53/258; 17/39; 53/122

[58] Field of Search ..... 53/258, 122; 17/36, 17/38, 39, 41

[56] References Cited

U.S. PATENT DOCUMENTS

| | | | |
|---|---|---|---|
| 3,473,190 | 10/1969 | Kielsmeier et al. | 17/41 |
| 3,964,236 | 6/1976 | Smith | 53/122 |

*Primary Examiner*—Travis S. McGehee
*Attorney, Agent, or Firm*—Gerald J. Ferguson, Jr.; Joseph J. Baker

[57] ABSTRACT

A packaging apparatus for enveloping an article in a sleeve-type package includes a rigid elongate tube of U-shape and, in use, substantially horizontally oriented with one end secured to a table-top mountable support, the member being otherwise free-standing and having at its other end a cylinder of greater diameter than the tube and within which articles to be packed are locatable. The tube serves as a magazine for a sleeve of netting fed thereonto. The outer end of the sleeve is tied and the sleeve is removed from over said cylinder by an article such as a roll or piece of meat, located in said cylinder, being discharged therefrom, the sleeve being cut at the outer end of said cylinder when the sleeve-enveloped article is remote therefrom, and then tied. The article is discharged from the cylinder by a free-moving piston located therein and operated by air fed through the tube from a supply of compressed air. Air escape ports are provided in the cylinder wall to allow the air to escape after the piston has reached its forward maximum stroke thereby preventing the piston from moving out of the cylinder.

9 Claims, 4 Drawing Figures

PACKAGING APPARATUS

This invention relates to packaging apparatus for enveloping an article in a sleeve-like package.

Heretofore, a particular problem has existed in the meat trade in packaging rolls and pieces of meat in elasticated tubular netting. For this purpose a funnel has been provided slightly tapered towards its outlet end and having an outstanding flange around the inlet end. A roll or piece of meat is pushed by hand into the funnel at the inlet end and force through the slightly narrower outlet, thus compressing the meat which, while leaving the funnel, is encased in a sleeve of netting. The netting is mounted lengthwise around the funnel adjacent the outer face thereof and the main disadvantage encountered is in the difficulty of loading the netting on to the funnel because it is necessary to expand the netting beyond its normal size. A further disadvantage is that only a short length of netting can be accommodated on the funnel at one time because the length of the funnel is restricted to about 18 inches (45.7 centimeters) in length.

It is an object of the present invention to obviate or mitigate the aforesaid disadvantages.

The present invention is a packaging apparatus comprising a cylinder having an open mouth at one end, a freely movable piston slidably mounted within the cylinder, a rigid tubular member whose cross-sectional area is less than that of the cylinder, said tubular member being connected at one end to that end of the cylinder remote from the mouth and adapted at its other end for connection to a source of compressed air for actuation of the piston, the tubular member having means at or adjacent its said other end for securing the member to a support, and said tubular member having releasable connecting means which, when released, permits loading of a sleeve of elasticated netting in the unexpanded state around said tubular member.

Preferably, the releasable connecting means is located at the cylinder end of the tubular member whereby the cylinder is removable from the tubular member to permit loading at that end of the tubular member.

Preferably also, the tubular member is a rigid tube of 1 to 2 inches (2.5 to 5 centimeters) diameter, and the cylinder is a rigid member of 3 to 8 inches (7.6 to 20 centimeters) diameter.

Preferably further, a support cradle is provided partly around but spaced from said cylinder to provide support to the cylinder end of the apparatus, should the cylinder abut against it, when an article is located therein.

Embodiments of the present invention will now be described, by way of example, with reference to the accompanying drawings, in which.

Figure 1:
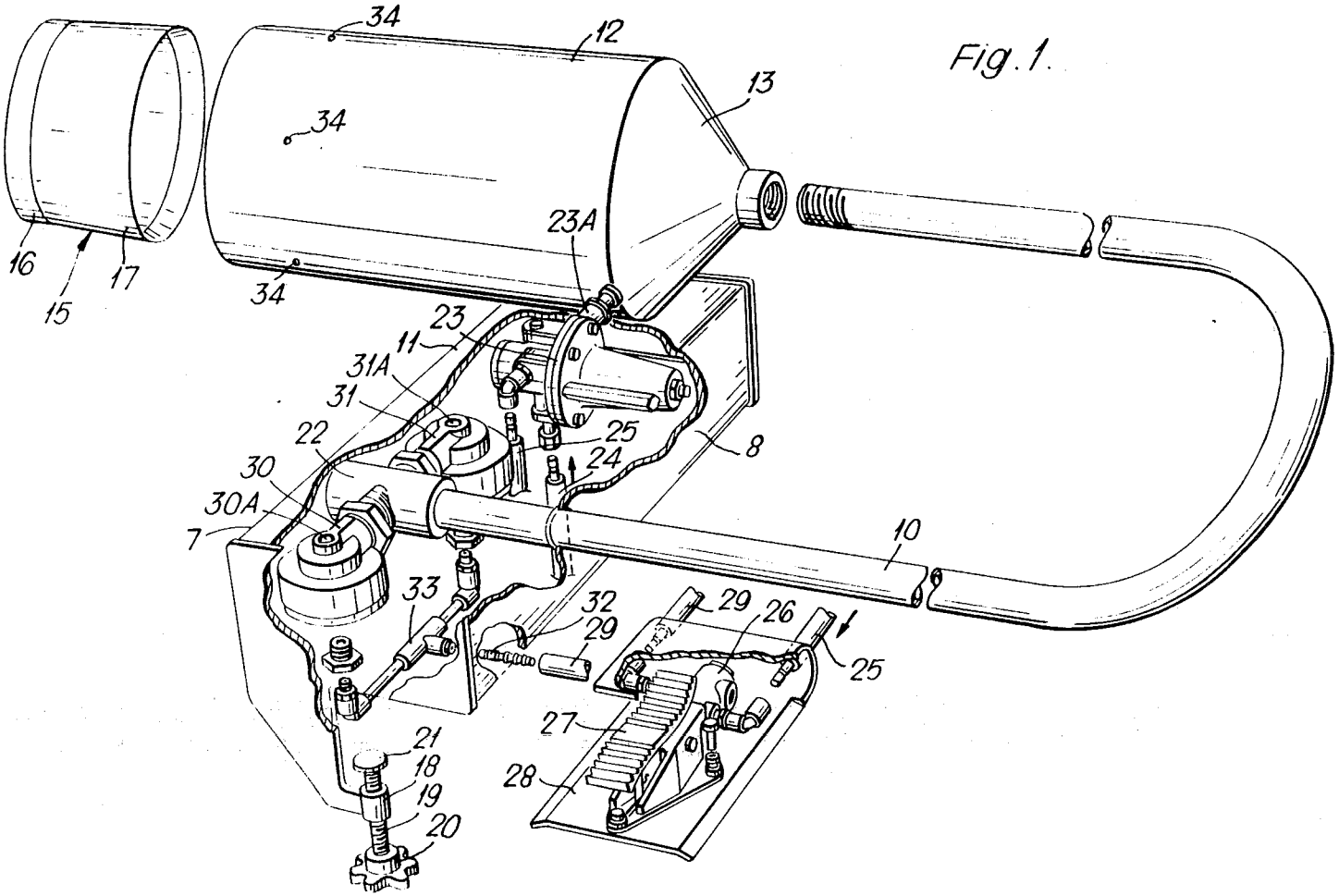
FIG. 1 is an exploded perspective view of a packaging apparatus according to a first embodiment of the present invention with a support of said apparatus being cut-away to show details of parts mounted therein.

Referring to FIG. 1 of the drawings, packaging apparatus according to a first and preferred embodiment comprises a rigid tubular member formed by an elongate tube 10 secured at one end to a horizontally oriented support 11 incorporating a mounting clamp attachable to a surface, such as a table top. Apart from this securement, the tube 10 is otherwise free-standing. The other end of the tube 10 has attached thereto a cylinder 12 of greater diameter than the tube 10, the rear end of the cylinder 12 having a conical face 13 decreasing to the diameter of the tube 10. The cylinder 12 which may also be made of stainless steel, is removably attached to the tube 10, for example, by screw threading as shown in FIG. 1, or by a bayonet joint and may have an internal diameter of 4 to 6 inches (10 to 15 centimeters). The tube 10, which may be 1 to 2 inches (2.5 to 5 centimeters), is U-shaped and in use is substantially horizontally oriented with the axis of the cylinder 12 and that part of the tube 10 forming one limb of the U being in a higher plane than the axis of that part of the tube 10 forming the other limb and the web is inclined between the two limbs. The support 11 is located below the gap between the two ends of the limbs remote from the web and transverse of said limbs. The support 11 is an elongate housing having opposed sides 7 and 8 between two ends and a top across the area defined thereby, the bottom parts of both ends are shaped into the bottom part of a 'G' clamp terminating in a tapped boss 18 in which a clamp screw 19 is in threaded engagement and having at its lower end a knurled knob 20 for moving the screw up or down relative to the boss 18, the upper end of said screw carrying a pressure pad 21. The secured end of the tube 10 is fixed to one end of securing means in the form of a tubular mounting 22 which is secured at its opposite end to the inside of side 7. The tube 10 then passes through a hole in the opposed side 8 and is welded thereto. The tubular mounting 22 has two diametrical opposed ports for the purpose hereinafter described, the axis of which is parallel to the top of the housing. The inside of the cylinder 12 is adapted to receive a roll or piece of meat and means to discharge said roll or piece of meat comprises a free-moving piston 15 located inside the cylinder 12 and a supply of compressed air communicating with the cylinder 12 via the secured end of the tube. The piston 15, which may be made of plastics, has a head 16 of similar areal dimensions to the inside diameter of the cylinder 12 and with a skirt surround 17 extending rearwardly. A pressure regulator 23 having a relief valve 23A is mounted inside the housing and coupled by hosing 24 to the supply of compressed air. The pressure regulated air is then fed by hosing 25 to a control valve 26 operated by a foot pedal 27 mounted on a base plate 28. On depression of the foot pedal 27, air flows from hosing 25 to hosing 29, thence through connector 32 to a T-connector 33 whence air passes through both pipes in the T-connector into non-return valves 30 and 31 which are coupled, one to each port in the tubular mounting 22. The valves 30 and 31 are non-return diaphragm valves which enable air to pass therethrough into the tube 10 and also enables air in the tube 10 to escape therefrom to atmosphere when the piston 15 is moved back into the cylinder 12 by a roll or a piece of meat or other article being pushed into the cylinder 12. The air escapes through exhaust ports 30A and 31A respectively into the housing, thence to atmosphere, thereby permitting faster return of the piston in the cylinder. To prevent the piston 15 from movement out of the cylinder 12, four equi-spaced radial air escape ports 34 are provided in the wall of the cylinder 12. However, circumferential air escape grooves or channels can be provided around the inner face of the cylinder 12 adjacent to the mouth thereof. The piston 15 is moved rearwardly of the cylinder as the next article to be packaged abuts it and is manually pushed into said cylinder 12.

Means to cut the sleeve 14 adjacent to the mouth of the cylinder 12 is provided and said means may be any conventional cutting mechanism such as a guillotine, a hand knife or scissors.

Figure 2:
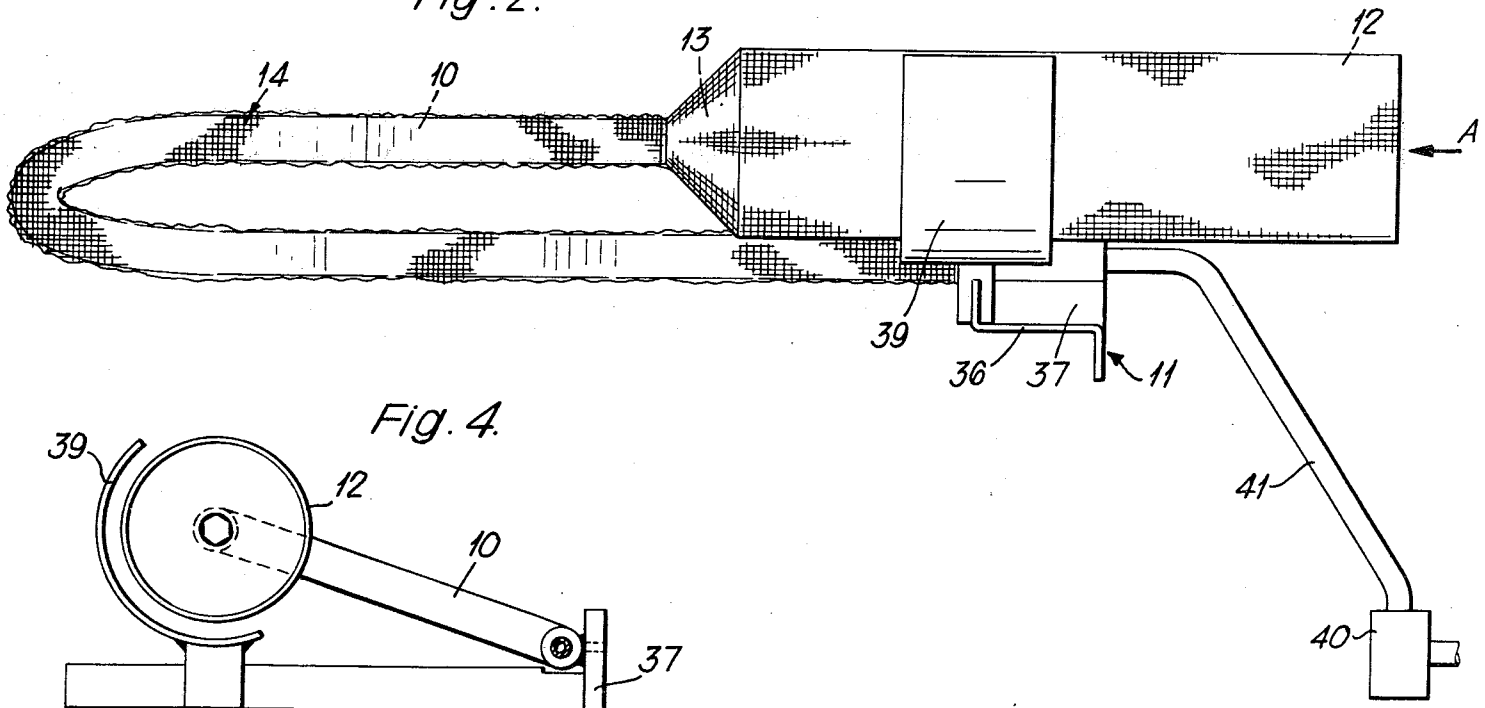
FIG. 2 is a diagrammatic side elevation of a packaging apparatus according to a second embodiment, and showing a sleeve of netting located on a tubular member.

The apparatus is prepared for use by firstly removing the cylinder 12 then loading the tube 10 with one or more sleeves of elasticated netting 14 (as shown in FIG. 2). As the tube 10 is only about 1 inch (2.5 centimeters) in diameter the netting, which is of greater diameter even in its unexpanded state, slips easily over the tube 10 and on a tube about 1 meter long, 10, 20, or 50 meters of netting can be accommodated. The cylinder 12 is then remounted and the adjacent end of the netting is pulled over the cylinder 12 towards the mouth. As the netting in its unexpanded state is of smaller diameter than the cylinder 12, the portion of netting engaging the cylinder is temporarily expanded. A roll or piece of meat is then manually pushed into the cylinder 12 through its mouth and the outer end of the sleeve is pulled off the cylinder 12 and tied or otherwise secured across the mouth. The foot pedal 27 is then actuated, air is fed through the tube 10 into the cylinder 12 and the piston 15 is moved slowly forward pushing the meat in front of it until the meat is at least partially ejected through the mouth. In doing so, a portion of the sleeve 14 is pulled off the cylinder 12 and in contracting towards its unexpanded diameter, firmly encases the meat. When the piston 15 reaches its maximum forward stroke the sleeve-enveloped meat is manually drawn away from the cylinder causing a further portion of the sleeve 14 to be pulled on to the cylinder 12. The part of the sleeve 14 encasing the meat is cut adjacent to the mouth of the cylinder 12 and the cut end part of the sleeve enveloping the meat contracts to firmly engage the end face of the meat. The netting may, however, be tied or otherwise secured. The pressurized air pushing the piston towards the mouth of the cylinder escapes through the air escape ports when the piston reaches its maximum forward stroke. The piston is moved rearwardly of the cylinder as the next roll or piece of meat to be packaged abuts it and is pushed into said cylinder 12. The air trapped between the piston and non-return valves escapes to atmosphere as the piston is pushed into the cylinder. The process can then be repeated many times and only when the supply of netting has been exhausted is it necessary to reload with a fresh supply.

A series of cylinders, each with a different diameter may be provided to accommodate different sized articles.

Figure 4:
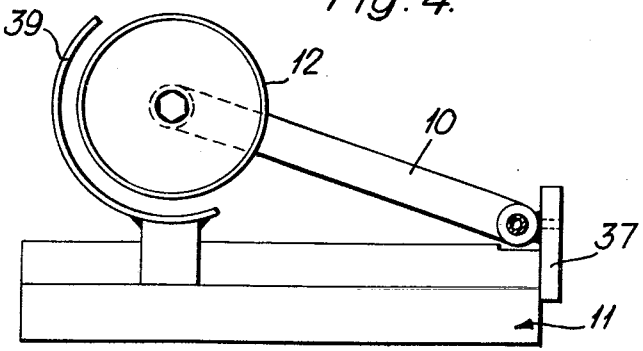
FIG. 4 is a diagrammatic end view in the direction of arrow 'A' shown in FIG. 2.
Figure 3:
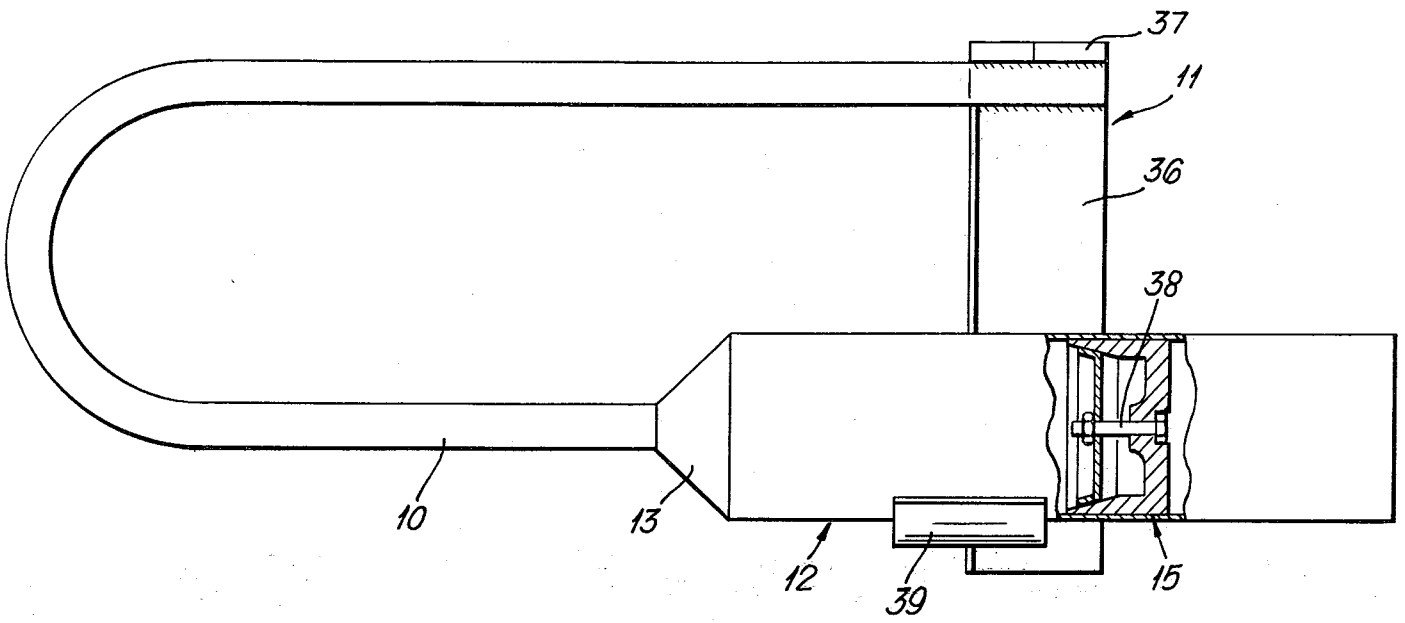
FIG. 3 is a diagrammatic plan view of the apparatus shown in FIG. 2.

In the second or simplified embodiment as shown in FIGS. 2, 3 and 4, like parts are denoted by like numerals. The support 11 comprises an elongate plate 36 transverse of the limbs of the tube 10 and having an upright 37 at one side thereof to which the secured end of the tube 10 is fixed, the plate being attachable to a surface by clamps (not shown).

The secured end of the tube 10 is coupled by hosing 41 to a supply of low pressure compressed air, and a control box 40 interposed in hosing 41 controls the flow of air from the supply.

The piston 15 has an adjustment mechanism 38 adapted to force the skirt surround 17 peripherally into abutment with the inner face of the cylinder 12 to compensate for wear.

A support cradle 39 comprises a support upstanding from said plate 36 adjacent to the opposite end from the upright 37 and has an arcuate arm secured to its top, the curve of which arm has a radius whose origin is that of the axis of the cylinder 12. The arm is spaced from the cylinder 12 and will support the cylinder if the cylinder, when weighted with a roll or piece of meat, drops a small predetermined distance (e.g. about ½ inch (1.3 centimeters)) below its normal position.

The apparatus according to this second embodiment is used in the same manner as that described for the first embodiment, the control box being operated instead of the foot pedal. The cradle 39 provides support for the portion 12 during loading of an article therein or during the action of locating a sleeve of netting 14 onto the member 10.

A support cradle may be provided for use in the first embodiment, as can an adjustment mechanism in the piston.

Thus, the apparatus as hereinbefore described in bothembodiments has an advantage over known devices in that the need to replenish the netting is greatly reduced thus improving the efficiency of operation. In addition, there is no need when loading to stretch the netting except for the first small initial length which is pulled over the cylinder.

In a modification, the releasable connecting means on the tube may be remote from the cylinder, for example, at the other end of the tube. In such a modification, the sleeve of netting would be loaded on to the tube in a direction towards the cylinder which, of course, would not need to be removably connected to the tube. The position of the releasable connecting means could be at any convenient location on the tube, and for practical purposes, this would be at or close to one or other end.

The tube may be other than U-shaped and substantially horizontally oriented; for example, L-shaped with the limb containing the cylinder horizontal and the other horizontal, vertical or at any other convenient angle.

The tubular member is preferably made of stainless steel for hygienic purposes, for which reason also the sleeves of netting are slidably mounted thereon. However, and especially where hygiene is not an important consideration, the tubular member may comprise a relatively narrow tube capable of carrying the low pressure compressed air and a support surrounding or partially surrounding the tube and which, although not airtight, is capable of slidably locating the unexpanded sleeves of netting thereon.

It will be appreciated that while the apparatus is particularly applicable to the meat trade, it can be adapted for packaging articles other than meat. The apparatus can also be adapted, with the use of a nozzle, to assist in making skin filled meat products, such as sausages and black puddings.

What is claimed is:

1. A packaging apparatus comprising a cylinder having an open mouth at one end, a freely movable piston slidably mounted within the cylinder, a rigid tubular member whose cross-sectional area is less than that of the cylinder, said tubular member being connected at one end to that end of the cylinder remote from the mouth and adapted at its other end for connection to a source of compressed air for actuation of the piston, a support means at or adjacent the other end of said tubular member for securing the member to the support, and releasable connecting means on said tubular member which, when released, permits loading of a sleeve of elasticated netting in the unexpanded state around said tubular member.

2. A packaging apparatus according to claim 1, wherein the releasable connecting means is located at the cylinder end of the tubular member enabling the cylinder to be removable from the tubular member to permit loading at that end of the tubular member.

3. A packaging apparatus according to claim 1, wherein the tubular member is a rigid tube of 1 to 2 inches (2.5 to 5 centimeters) diameter, and the cylinder is a rigid member of 3 to 8 inches (7.6 to 20 centimeters) diameter.

4. A packaging apparatus according to claim 1, wherein the member is U-shaped and in use is substantially horizontally oriented, the axis of the cylinder and of that part of the member forming a limb thereof being in a higher plane than the axis of that art of the member forming the other limb.

5. A packaging apparatus according to claim 1, wherein the free-moving piston has a head of similar areal dimensions to the inside diameter of the cylinder and a skirt surround extending rearwardly.

6. A packaging aparatus according claim 1, wherein the supply of compressed air communicates with the secured end of the member through hosing to a pressure regulator thence to a control valve operated by a foot pedal and thence to two non-return valves which feed respectively into said member through two diametrical opposed ports in said means at the secured end of the member.

7. A packaging apparatus as claimed in claim 5, wherein a plurality of equi-spaced radial air escape ports are provided in the wall of the cylinder to prevent the compressed air moving the piston out of the cylinder beyond its maximum forward stroke.

8. A packaging apparatus as claimed in claim 6, wherein the support is an elongate housing in which the pressure regulator and non-return valves are mounted, the housing having two ends, the bottom parts of which are shaped into the bottom parts of a 'G' clamp and terminate in a tapped boss with which a clamp screw is in threaded engagement having a pressure plate at its end and a knob at its lower end by rotation of which the screw can be moved up or down relative to the boss.

9. A packaging apparatus according to claim 4, wherein a support cradle is provided partly around but spaced from said cylinder to provide support to the cylinder end of the apparatus, should the cylinder abut against it when an article is located therein.

* * * * *

UNITED STATES PATENT AND TRADEMARK OFFICE

CERTIFICATE OF CORRECTION

PATENT NO. : 4,150,521

DATED : April 24, 1979

INVENTOR(S) : JOHN REILLY

It is certified that error appears in the above-identified patent and that said Letters Patent are hereby corrected as shown below:

ASSIGNEE: BIGGER & JOHNSTON LIMITED
DONAGHADEE,
COUNTY DOWN,
NORTHERN IRELAND

Signed and Sealed this

*First* Day of *January 1980*

[SEAL]

*Attest:*

SIDNEY A. DIAMOND

*Attesting Officer*

*Commissioner of Patents and Trademarks*